US007545349B2

(12) United States Patent
Yamada

(10) Patent No.: US 7,545,349 B2
(45) Date of Patent: Jun. 9, 2009

(54) DISPLAY DEVICE AND DISPLAY MODULE OF MOVABLE BODY

(75) Inventor: Tadashi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 633 days.

(21) Appl. No.: 11/348,346

(22) Filed: Feb. 7, 2006

(65) Prior Publication Data

US 2006/0202630 A1 Sep. 14, 2006

(30) Foreign Application Priority Data

Mar. 8, 2005 (JP) ..... 2005-063480

(51) Int. Cl.
*G09G 5/00* (2006.01)

(52) U.S. Cl. ..... 345/76; 345/77

(58) Field of Classification Search ..... 345/76–77
See application file for complete search history.

(56) References Cited

U.S. PATENT DOCUMENTS

| | | | | |
|---|---|---|---|---|
| 5,019,807 | A * | 5/1991 | Stapleton et al. | 345/206 |
| 5,216,504 | A * | 6/1993 | Webb et al. | 348/190 |
| 5,428,370 | A * | 6/1995 | Knapp et al. | 345/205 |
| 7,158,106 | B2 * | 1/2007 | Cok et al. | 345/76 |
| 7,321,348 | B2 * | 1/2008 | Cok et al. | 345/82 |
| 7,446,743 | B2 * | 11/2008 | Kwasnick | 345/77 |
| 2005/0007392 | A1 * | 1/2005 | Kasai et al. | 345/690 |
| 2005/0012698 | A1 * | 1/2005 | Takahashi | 345/77 |
| 2005/0248517 | A1 * | 11/2005 | Luther Weindorf | 345/82 |
| 2005/0280766 | A1 * | 12/2005 | Johnson et al. | 349/167 |
| 2006/0125734 | A1 * | 6/2006 | Cok et al. | 345/76 |

FOREIGN PATENT DOCUMENTS

| | | |
|---|---|---|
| JP | A-62-75588 | 4/1987 |
| JP | U-06-040992 | 5/1994 |
| JP | A-2000-315070 | 11/2000 |
| JP | A-2001-312249 | 11/2001 |
| JP | A-2003-202838 | 7/2003 |
| JP | A 2004-127924 | 4/2004 |
| JP | 2004-226507 | 8/2004 |
| JP | A 2004-291731 | 10/2004 |
| JP | A-2004-354635 | 12/2004 |
| JP | A-2005-31430 | 2/2005 |
| KR | 10-2004-0104357 A | 12/2004 |

* cited by examiner

*Primary Examiner*—Richard Hjerpe
*Assistant Examiner*—Nelson Lam
(74) *Attorney, Agent, or Firm*—Oliff & Berridge, PLC

(57) ABSTRACT

A display device includes a display panel that has a plurality of pixels disposed in a matrix so as to correspond to intersections of a plurality of scanning lines and a plurality of data lines and a plurality of light-emitting elements provided in each of the plurality of pixels. The display device drives the display panel on the basis of image data. The display device further includes a temperature detecting unit that detects the temperature of the display panel; and a display aspect changing unit that changes a display aspect of the display panel so as to decrease the luminance of each of light-emitting elements, among the plurality of light-emitting elements provided in each of the plurality of pixels, which have high temperature dependency of characteristic deterioration, when the temperature of the display panel detected by the temperature detecting unit becomes larger than a predetermined threshold value.

5 Claims, 7 Drawing Sheets

RED BASE

DIGITAL DISPLAY WITH BLUE

DISPLAY DEVICE AND DISPLAY MODULE OF MOVABLE BODY

BACKGROUND

1. Technical Field

The present invention relates to a display device, such as an organic EL display device or the like that is mounted on a movable body of a vehicle such as an automobile, an airplane, a ship, a streetcar or the like and that displays a speed of a movable body, an engine speed, geographical information of a car navigation device or the like, and to a display module of the movable body.

2. Related Art

In recent years, an organic EL panel using an organic electroluminescent (hereinafter, referred to as 'EL') element has attracted attention because it is superior than other devices in low power consumption, a wide viewing angle, and a high contrast ratio. An example of the organic EL display device using the organic EL panel has been disclosed (for example, JP-A-2004-127924).

In addition, as an example of an information display device for a vehicle which is mounted on an instrument panel of a vehicle such as an automobile or the like, an information display device in which a plurality of display is performed on one screen composed of a liquid crystal display device (multi-display device) has been known (for example, see JP-A-2004-291731). In such an information display device for a vehicle, one liquid crystal panel is used. In the liquid crystal panel, three kinds of display is performed by means of a first display unit serving as a speedometer for displaying a speed, a second display unit serving as a tachometer for displaying an engine speed, and a third display unit for displaying geographical information of a car navigation device.

However, in the organic EL display device according to the related art disclosed in JP-A-2004-127924, three kinds of organic EL elements for R, G, and B (organic EL elements for red, green, and blue) disposed in a matrix are different from one another in thermal deterioration and thermal stability. For example, a material of each of the organic EL elements for red and green is vulnerable to the heat (temperature dependency of characteristic deterioration is high), but a material of the organic EL element for blue is not deteriorated even when the temperature becomes high.

In a case in which this organic EL display device is mounted on an instrument panel of a vehicle such as an automobile or the like and various vehicle information such as a vehicle speed and an engine speed or the like is displayed on the organic EL panel, if the temperature of the organic EL panel becomes high, the life span of each of the organic EL elements becomes shortened. In the vehicle such as the automobile or the like, it is required that each of organic EL elements of the organic EL panel should emit light normally even when the indoor temperature of the vehicle or the temperature of the organic EL panel is about 85° C. For this reason, when the organic EL panel becomes a high temperature, a countermeasure needs to be arranged in order to prevent the life span of each organic EL panel from being shortened. In addition, in a gauge board of a movable body, for example, an instrument panel of a vehicle such as an automobile or the like, various indicators can perform only limited types of display.

SUMMARY

An advantage of some aspects of the invention is that it provides a display device capable of performing various information display or pixel display while preventing a light-emitting element from being deteriorated even when the temperature of a display panel becomes a high temperature, and a display module of a movable body.

According to a first aspect of the invention, there is provided a display device which includes a display panel that has a plurality of pixels disposed in a matrix so as to correspond to intersections of a plurality of scanning lines and a plurality of data lines and a plurality of light-emitting elements provided in each of the plurality of pixels. The display device drives the display panel on the basis of image data. Further, the display device includes a temperature detecting unit that detects the temperature of the display panel; and a display aspect changing unit that changes a display aspect of the display panel so as to decrease the luminance of each of light-emitting elements, among the plurality of light-emitting elements provided in each of the plurality of pixels, which have high temperature dependency of characteristic deterioration, when the temperature of the display panel detected by the temperature detecting unit becomes larger than a predetermined threshold value.

According to this aspect, the light-emitting elements having high temperature dependency of characteristic deterioration can be prevented from being deteriorated, and the display can be changed by the temperature of the display panel. In a case in which this display device according to this aspect is mounted on an instrument panel of a vehicle such as an automobile or the like and a speedometer or a tachometer performs the display on the display panel, even when the temperature of the display panel increases, the display such as the speedometer or the like can be performed while preventing the light-emitting element from being deteriorated. The display aspect of the speedometer or the like is changed depending on the temperature of the display panel, so that a gauge panel of a movable body, for example, the display aspect of the entire instrument panel of the vehicle such as the automobile or the like can be changed. Accordingly, even in a severe environment in which the temperature of the display panel increases, the display of various information or the pixels can be performed while preventing the light-emitting element from being deteriorated.

Further, in the present specification, 'characteristic deterioration' means that the light-emitting element is turned on and element characteristics of the light-emitting element such as the luminance and the light-emitting efficiency of the light-emitting element are deteriorated. When the light-emitting element is turned on in the high temperature circumference, the characteristic deterioration is accelerated. When the light-emitting element is turned on at any temperature, the characteristic deterioration is severe. In this case, the light-emitting element is defined as a light-emitting element having high temperature dependency of characteristic deterioration.

Preferably, each of the plurality of pixels has a three kinds of light-emitting elements that includes a red light-emitting element to irradiate a red light component, a green light-emitting element to irradiate a green light component, and a blue light-emitting element to irradiate a blue light component. According to this aspect, since the light-emitting element having high temperature dependency of characteristic deterioration can be prevented from being deteriorated, the life span of the display panel can be increased.

Preferably, the display aspect changing unit has a luminance adjusting unit that changes a luminance ratio of each of the three kinds of light-emitting elements so as to decrease the luminance of each of light-emitting elements, among the three kinds of light-emitting elements, which have high temperature dependency of characteristic deterioration, while maintaining the luminance of all of the three kinds of light-emitting elements at a predetermined value, when the temperature of the display panel becomes larger than the predetermined threshold value.

According to this aspect, if the detected temperature of the display panel becomes larger than the threshold value, the luminance of all the three kinds of light-emitting elements is maintained as a predetermined value, and the light-emitting elements having high temperature dependency of characteristic deterioration, for example, the luminance of each of the red light-emitting element and the green light-emitting element can be decreased. The luminance of the light-emitting element having low temperature dependency of characteristic deterioration, for example, the luminance of the blue light-emitting element can be increased as much as the luminance of the red light-emitting element or the green light-emitting element is decreased. Thereby, the light-emitting elements having high temperature dependency of characteristic deterioration can be prevented from being deteriorated without changing the luminance of the entire screen, so that the life span of the display panel can be increased. If the temperature of the display panel becomes larger than the threshold value or becomes the threshold value or less, the luminance ratio of each of the three kinds of three kinds of light-emitting elements is changed, so that the display can be changed. Accordingly, in a case in which the display device according to the first aspect is mounted on the instrument panel of the vehicle such as the automobile or the like as the movable body and the speedometer or tachometer performs the display in the display panel, even when the temperature of the display panel becomes a high temperature, the display aspect of the entire instrument panel can be changed while increasing the life span of the display panel.

Preferably, the display aspect changing unit has a luminance adjusting unit that changes display of a background color of an image displayed on the display panel into display on the basis of a color of an light-emitting element, among the three kinds of light-emitting elements, which has low temperature dependency of characteristic deterioration, when the temperature of the display panel becomes larger than the predetermined threshold value.

According to this aspect, if the temperature of the display panel becomes larger than the threshold value, the display of the background color of the image displayed on the display panel is changed into the display on the basis of the color of the light-emitting element, among the three kinds of light-emitting elements, having low temperature dependency of characteristic deterioration, so that the display aspect can be changed while increasing the life span of the display panel. When the temperature of the display panel is low or high, since the background color of the image displayed on the display panel is changed, a user is under the impression that the display aspect of the instrument panel is changed.

Preferably, the display aspect changing unit has a luminance adjusting unit that decreases the luminance of each of the three kinds of light-emitting elements without changing the luminance ratio of each of the three kinds of light-emitting elements, when the temperature of the display panel becomes larger than a predetermined threshold value. According to this aspect, if the temperature of the display panel becomes larger than the threshold value, the luminance of each of the three kinds of light-emitting elements can be decreased without changing the luminance ratio of each of three kinds of light-emitting elements. Therefore, since the light-emitting elements having high temperature dependency of characteristic deterioration can be prevented from being deteriorated, the life span of the display panel can be increased.

Preferably, the display aspect changing unit has an image processing unit that changes the display in the display panel from analog display to digital display and changes the digital display into display on the basis of a color of a light-emitting element, among the three kinds of light-emitting elements, which has low temperature dependency of characteristic deterioration, when the temperature of the display panel becomes larger than a predetermined threshold value. According to this aspect, when the temperature of the display panel is low, the display by the display panel, for example, the various movable body information, such as the vehicle speed or the engine speed, is displayed in an analog form by the meter. In addition, if the temperature of the display panel becomes larger than the threshold value, the various movable body information is displayed in a digital form by using a color of a light-emitting element, among the three kinds of light-emitting elements, having low temperature dependency of characteristic deterioration. For this reason, even in a severe environment in which the temperature of the display panel becomes a high temperature, the light-emitting elements having high temperature dependency of characteristic deterioration can be prevented from being deteriorated, so that the display aspect can be changed while increasing the life span of the display panel.

Preferably, the display aspect changing unit displays on the display panel a message indicating that the digital display is temporary display until the temperature of the display panel decreases, when the digital display is performed by the display panel. According to this aspect, it is possible to notify a passenger that the digital display is temporary display until the temperature of the display panel decreases by means of the message displayed together with the digital display.

According to a second aspect of the invention, there is provided a display module of a movable body which includes a plurality of display panels each of which has a plurality of pixels disposed in a matrix so as to correspond to intersections of a plurality of scanning lines and a plurality of data lines and has a plurality of light-emitting elements provided in each of the plurality of pixels. The display module of a movable body performs different display on each of the plurality of display panels on the basis of image data. The display module of a movable body further includes a temperature detecting unit that detects the temperature of the display panel; and a display aspect changing unit that changes display aspects of some or all of the plurality of display panels so as to decrease the luminance of each of light-emitting elements, among the plurality of light-emitting elements provided in each of the plurality of pixels, which have high temperature dependency of characteristic deterioration, when the temperature of the display panel detected by the temperature detecting unit becomes larger than a predetermined threshold value.

According to this aspect, the light-emitting elements having high temperature dependency of characteristic deterioration can be prevented from being deteriorated, and the display can be changed by the temperature of the display panel. In a case in which the display device according to the second aspect is mounted on the instrument panel of the vehicle such as the automobile or the like and the different display of the speedometer or the tachometer is performed by means of the plurality of display panels, even when the temperature of the display panel becomes a high temperature, the display of the speedometer or the like can be performed while preventing the light-emitting element from being deteriorated. In addition, the display aspect of the speedometer or the like is changed by the temperature of the display panel, so that a gauge panel of a movable body, for example, the display aspect of the entire instrument panel of the vehicle such as the automobile or the like can be changed. Accordingly, even in a severe environment in which the temperature of the display panel becomes a high temperature, the display of various information or the pixels can be performed while preventing the light-emitting element from being deteriorated.

Preferably, each of the plurality of pixels has three kinds of light-emitting elements that includes a red light-emitting element to irradiate a red light component, a green light-emitting element to irradiate a green light component, and a blue light-emitting element to irradiate a blue light component.

According to this aspect, in the plurality of display panels, the light-emitting elements having high temperature dependency of characteristic deterioration can be prevented from being deteriorated, and the life span of the display panel can be increased. Accordingly, in a case in which the display module of the movable body according to this aspect is mounted on the instrument panel of the vehicle such as the automobile or the like and the different display of the speedometer or the tachometer is performed by means of the plurality of display panels, even when the temperature of the display panel becomes a high temperature, the display aspect of the entire instrument panel can be changed while increasing the life span of the display panel.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the preferred embodiments in which the invention is embodied will be described with reference to the accompanying drawings.

First Embodiment

Figure 1:
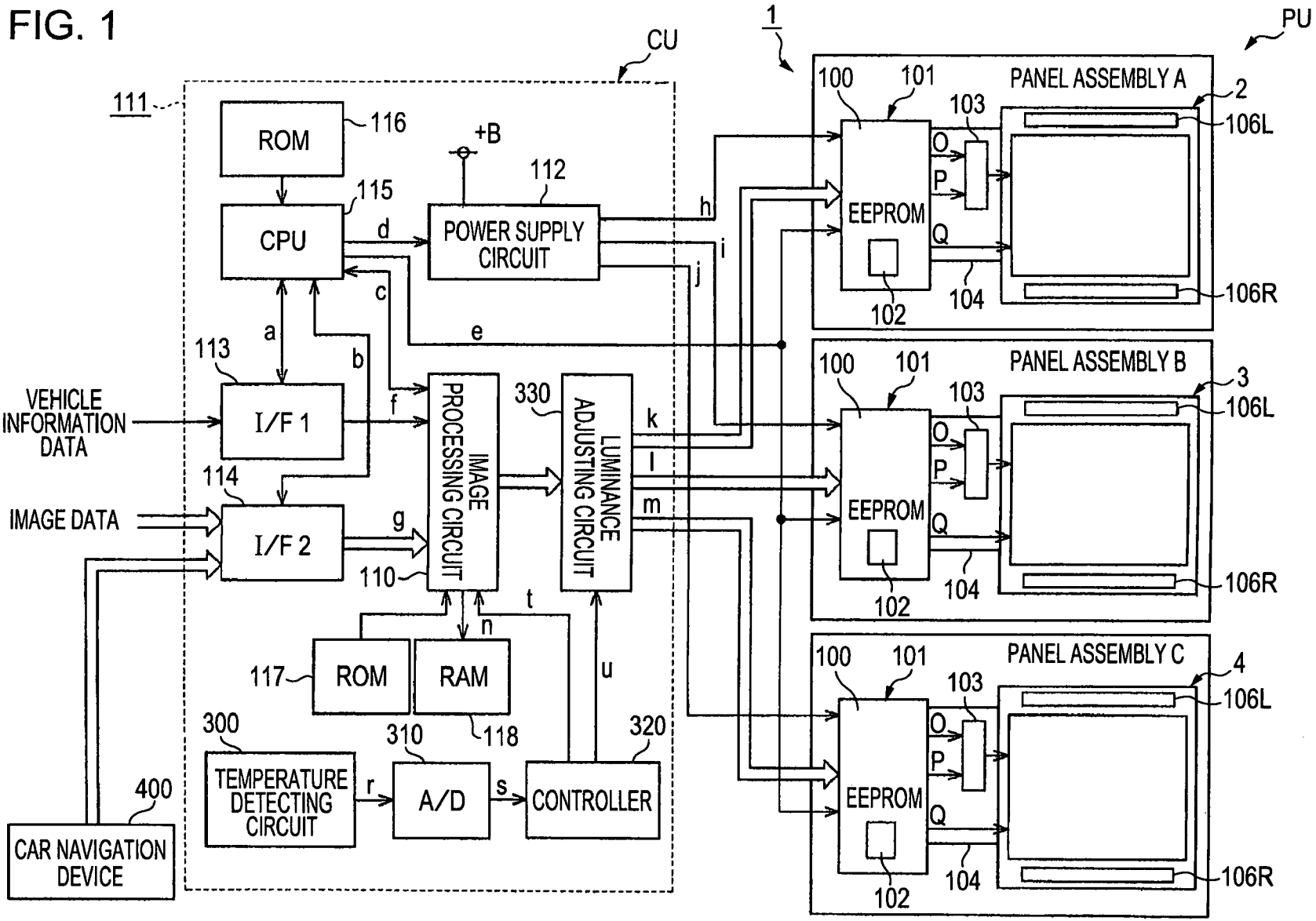
FIG. 1 is a block diagram illustrating an electrical configuration of a display module of a movable body according to a first embodiment of the invention.
Figure 2:
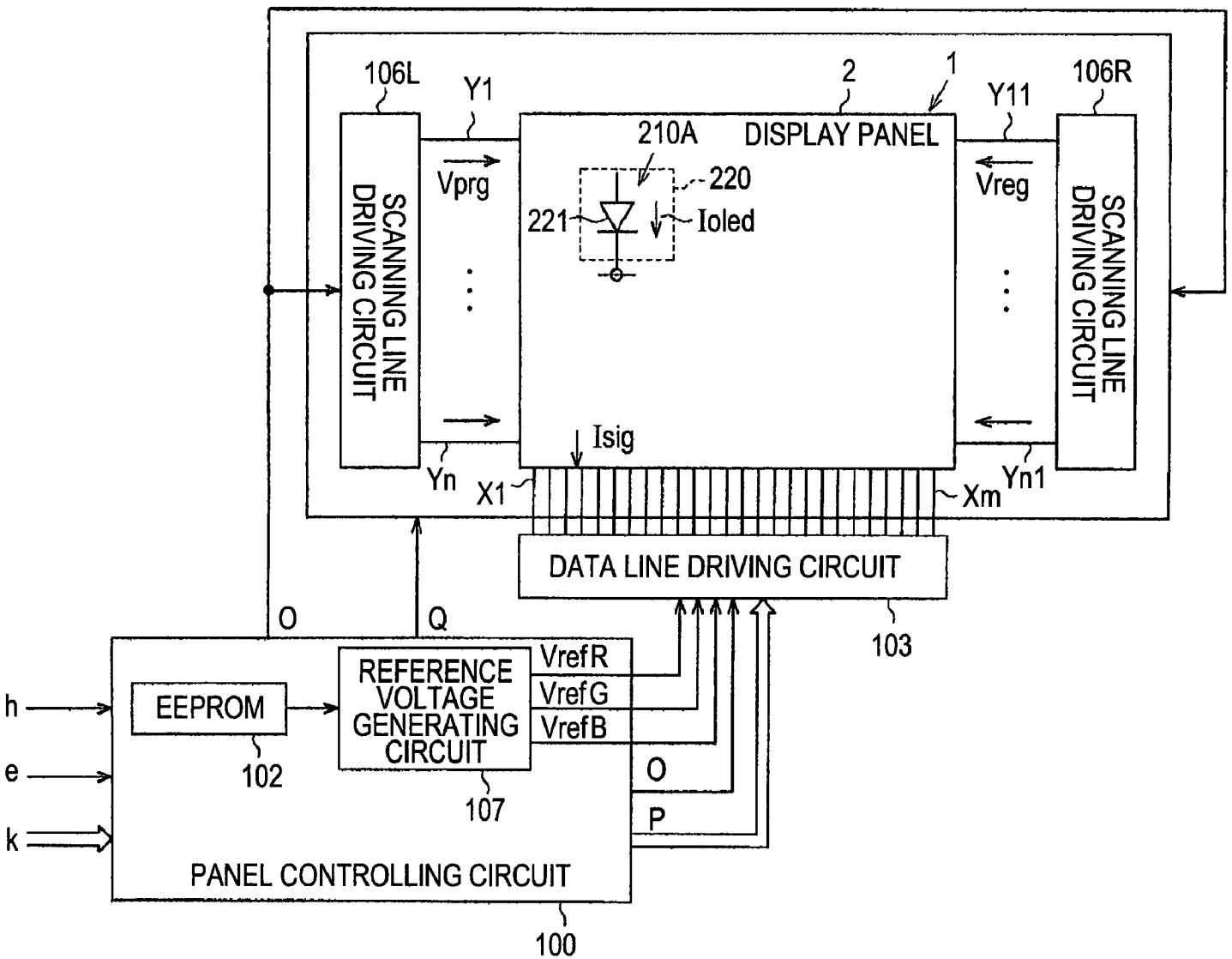
FIG. 2 is a block diagram illustrating an electrical configuration of a panel assembly used in the display module.
Figure 3A:
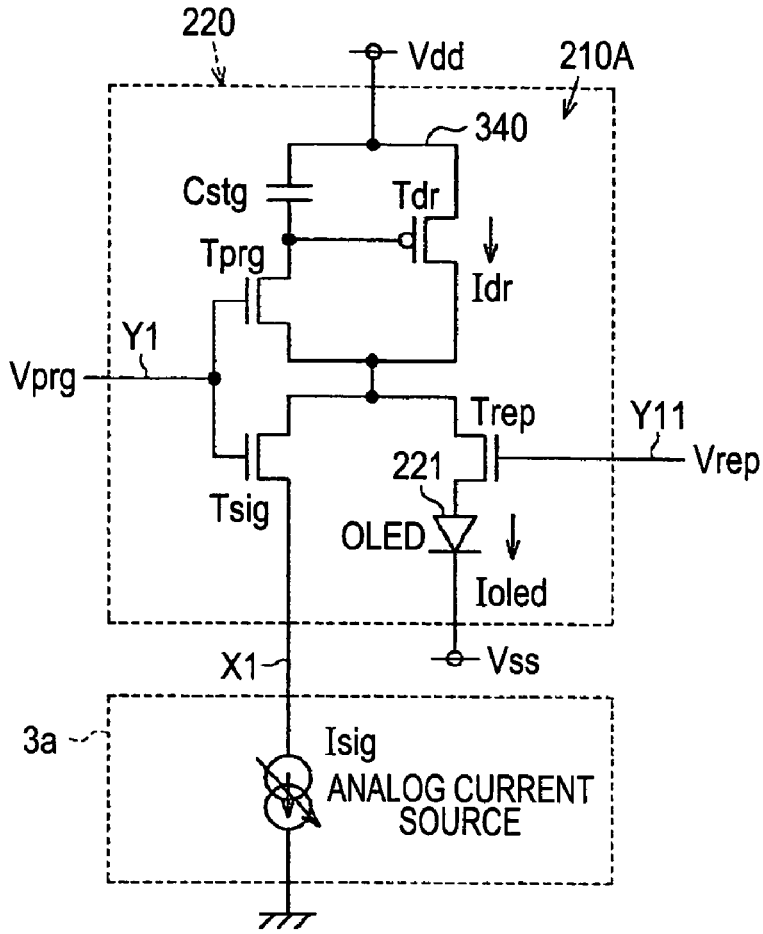
FIG. 3A is a circuit diagram illustrating a pixel circuit.

FIG. 1 is a diagram illustrating an electrical configuration of an entire display module of a movable body according to a first embodiment of the invention. FIG. 2 is a diagram illustrating a panel assembly used in the same display module. FIG. 3A is a diagram illustrating one pixel circuit.

As shown in FIG. 1, a display module 1 of a movable body has three panel assemblies A, B, and C that have three organic EL panels 2, 3, and 4 each serving as a display panel, respectively.

In the present embodiment, the display module 1 of the movable body includes a panel unit PU that has the three panel assemblies A, B, and C having the three organic EL panels 2, 3, and 4, respectively, and an image control unit CU. The image control unit CU creates a plurality of displaying image data on the basis of image data and vehicle information data serving as movable body information data, and includes a plurality of output ports that output the image data. In the display module 1 of the movable body, the panel assemblies A, B, and C are electrically connected to the plurality of output ports of the image control unit CU, and different display is performed on each of the organic EL panels 2, 3, and 4 on the basis of the plurality of displaying image data output from the plurality of output ports.

Electrical Configuration of Panel Assembly

Next, an electrical configuration of each of the panel assemblies A, B, and C will be described with reference to FIGS. 1 and 2.

Each of the panel assemblies A, B, and C has a panel control substrate 101 on which a panel control circuit 100 is provided. The panel control circuit 100 performs display on each of the organic EL panels 2, 3, and 4 using the plurality of displaying image data created on the basis of the vehicle information data and the image data. In the present embodiment, as an example, since an image processing circuit that performs image processing on the vehicle information data and the image data and a power supply circuit is provided in the image control unit CU, each of the panel control circuits 100 performs the display on each of the corresponding organic EL panels 2, 3, and 4 using the plurality of displaying image data transmitted from the image control unit CU.

In order to correct a difference in the luminance of each of the organic EL panels 2, 3, and 4, each of the panel control circuits 100 of the panel assemblies A, B, and C has an EEPROM 102 that serves as a storage unit in which luminance correction data is stored. The display module 1 of the movable body has a structure in which the luminance of each of the organic EL panels is automatically adjusted using the luminance correction data stored in each EEPROM 102, when a power is supplied thereto.

In addition, each of the panel control circuits 100 has a plurality of output terminals that output a control signal O, drive data P, and a panel power Q, respectively, in order to perform display on each of the organic EL panels 2, 3, and 4 using the plurality of displaying image data transmitted from the image control unit CU. The plurality of output terminals (not shown) are electrically connected to a plurality of data lines, a plurality of power lines, and a plurality of control signal lines of each of the organic EL panels 2, 3, and 4 through a plurality of wiring lines provided on a flexible wiring substrate 104 on which a driver IC 103 for driving each of the organic EL panels 2, 3, and 4 is mounted.

Each of the driver ICs 103 is composed of a data line driving circuit that drives a plurality of data lines of each of the organic EL panels 2, 3, and 4, which will be described in detail below. The control signal O controls a scanning line driving circuit, which will be described in detail below, or the driver IC (data line driving circuit). In addition, the drive data P is image data of each pixel (having three kinds of light-emitting elements including a red light-emitting element for radiating red light, a green light-emitting element for radiating green light, and a blue light-emitting element for radiating blue light), which will be described in detail below, for example, digital gray-scale data of 8 bits.

The flexible wiring substrate 104 is composed of, for example, a flexible print substrate (FPC). In addition, a plurality of input-side wiring lines (not shown) and a plurality of output-side wiring lines are formed on the flexible wiring substrate 104. The plurality of input-side wiring lines connect the plurality of output terminals of each panel control circuit 100 to the plurality of input terminals of the driver IC 103, and the plurality of output-side wiring lines connect the plurality of output terminals of the driver IC 103 to the plurality of data lines and the plurality of scanning lines of each of the organic EL panels 2, 3, and 4. In addition, power supply lines, which supply the panel power Q to the plurality of power supply lines of each of the organic EL panels 2, 3, and 4, are provided on each of the flexible wiring substrates 104.

Electrical Configuration of Organic EL Panel

Next, an electrical configuration of each of organic EL display devices, which includes the organic EL panels 2, 3, and 4 in the panel assemblies A, B, and C and the panel control circuits 100, will be described with reference to FIGS. 1 to 3. Since the organic EL display devices of the panel assemblies A, B, and C have the organic EL panels 2, 3, and 4 with the same structure, respectively, only the electrical configuration of the organic EL display device of the panel assembly A will be described, and the descriptions of the organic EL panels 3 and 4 of the other panel assemblies B and C will be omitted.

The organic EL display device of the panel assembly A uses a current-draw-type current driving method (current programming method). The organic EL display device includes the organic EL panel 2, two scanning line driving circuits 106L and 106R that are provided at left and right sides of the organic EL panel 2, the driver IC 103 that serves as the data line driving circuit, and the panel control circuit 100.

As shown in FIG. 2, the organic EL panel 2 has a plurality of pixels 210A that are disposed in a matrix of n rows×m columns so as to correspond to intersections of n first scanning lines Y1 to Yn (n is an integer) extending in a row direction and m data lines X1 to Xm (m is an integer) extending in a column direction. Further, the organic EL panel 2 further has n second scanning lines Y11 to Yn1 extending in a row direction. Each of the plurality of pixels 210A is composed of three kinds of organic EL elements 221 including a red organic EL element, a green organic EL element, and a blue organic EL element, which are disposed in the order of R, G, and B.

Figure 3B:
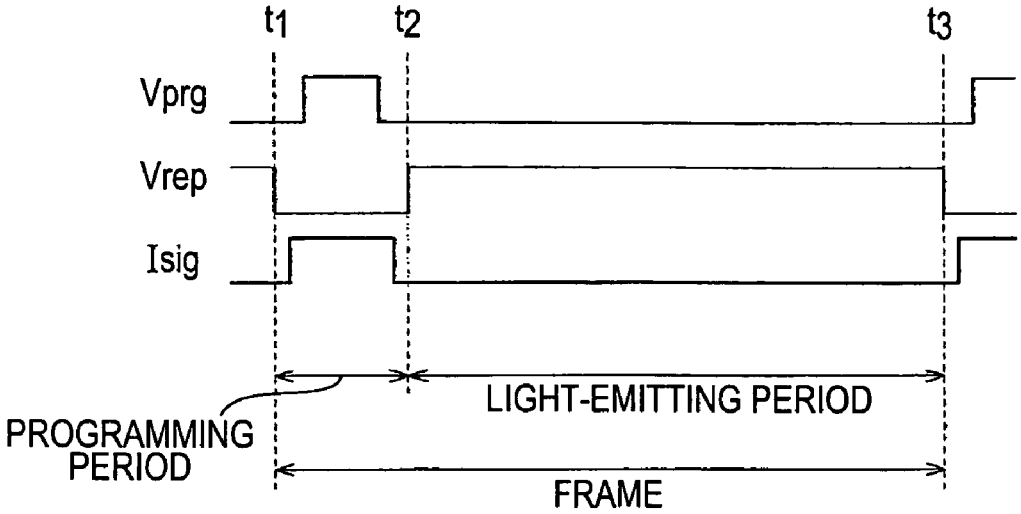
FIG. 3B is a timing chart illustrating the operation of the pixel circuit.

The scanning line driving circuit 106L sequentially generates and outputs a programming period selecting signal Vprg of an H level (see FIGS. 3A and 3B) with a timing in accordance with a synchronization signal and a clock signal input as the control signals O, and scans the first scanning lines Y1 to Yn in a line-sequential manner so as to select the scanning lines one by one. FIG. 3B illustrates only a programming period (a period from a point of time t1 to a point of time t2) for which the programming period selecting signal Vprg is output to a first row of scanning line Y1 among the first scanning lines Y1 to Yn.

The scanning line driving circuit 106R sequentially generates and outputs a light-emitting period selecting signal Vrep of an H level (see FIG. 3B) with a timing in accordance with a synchronization signal and a clock signal input as the control signals O, and scans the second scanning lines Y11 to Yn1 in a line-sequential manner so as to select the scanning lines one by one. FIG. 3B illustrates only a light-emitting period (a period from a point of time t2 to a point of time t3) for which the light-emitting period selecting signal Vrep of the H level is output to a first row of second scanning line Y11 among the second scanning lines Y11 to Yn1.

In addition, the driver IC 103 simultaneously supplies a programming signal current Isig (see FIG. 3B) to pixel circuits 220 connected to one first scanning line selected for the programming period through the data lines X1 to Xm.

Each programming signal current Isig is a current signal that is obtained by performing digital-to-analog conversion with respect to image data of a red pixel, a green pixel, and a blue pixel to be digital gray-scale data of n bits in the driver IC 103 in order to perform gray-scale display. In the present embodiment, the pixel data of each pixel 210A is digital gray-scale data that represents brightness of each pixel into the binary number of 8 bits, and has gray-scale values of 256 gray-scale levels within a range of 0 to 255.

As shown in FIG. 3, the driver IC 103 includes a data writing circuit (sampling circuit) that writes the programming signal current Isig in the respective pixel circuits 220 through the data lines X1 to Xm, a shift register that controls an operation timing of the data writing circuit, a latch circuit, and a D/A converter. The latch circuit stores the image data of each pixel in a data memory provided for every pixel and holds one row of image data. For the programming period, the image data stored in each data memory is simultaneously read out, and is then output to the D/A converter (not shown) in the driver IC 103.

As such, in the organic EL panel 2, the three kinds of organic EL elements 221 for R, G, and B (red organic EL element, green organic EL element, and blue organic EL element) constitutes one pixel 210A, and the plurality of pixels 210A are disposed in a matrix so as to correspond to intersections of the plurality of scanning lines and the plurality of data lines.

Each of the plurality of pixels 210A includes three kinds of pixel circuits for R, G, and B that have the red organic EL element for radiating red light from the light-emitting layer made of an organic semiconductor material, the green organic EL element for radiating green light from the light-emitting layer, and the blue organic EL element for radiating blue light from the light-emitting layer (see FIG. 3A). The three kinds of pixel circuits 220 constituting one pixel 210A have the same circuit structure, except that light with a different color is irradiated from each of the organic EL elements 221 of the three kinds of pixel circuits 220.

A structure of the pixel circuit 220 will be described on the basis of FIG. 3A.

The pixel circuit 220 includes a driving transistor Tdr, a programming transistor Tprg, a selection transistor Tsig at the time of programming, a selection transistor Trep at the time of emitting light, and a storage capacitor Cstg. The driving transistor Tdr is composed of a P-channel TFT. Each of the programming transistor Tprg, the selection transistor Tsig at the time of programming, and a selection transistor Trep at the time of emitting light is composed of an N-channel TFT.

A drain of the driving transistor Tdr is connected to an anode of the organic EL element 221 through the selection transistor Trep at the time of emitting light, and a cathode of the organic EL element 221 is connected to a ground. The drain of the driving transistor Tdr is connected to one data line (data line X1 in FIG. 3A) through the selection transistor Tsig at the time of programming. Further, a source of the driving transistor Tdr is connected to a high-potential power supply Vdd. Furthermore, a gate of the driving transistor Tdr is connected to a first electrode of the storage capacitor Cstg, and a second electrode of the storage capacitor Cstg is connected to the high-potential power supply Vdd. The programming transistor Tprg is connected between the gate and drain of the driving transistor Tdr.

The gates of the selection transistor Tsig at the time of programming and the programming transistor Tprg are connected to one first scanning line (first scanning line Y1 in FIG. 3A). In addition, the selection transistor Tsig at the time of programming and the programming transistor Tprg are turned on in response to the programming period selecting signal Vprg of an H level supplied from the first scanning line Y1 and are turned off in response to the programming period selecting signal Vprg of an L level. In addition, in the present embodiment, if the selection transistor Tsig at the time of programming and the programming transistor Tprg are turned on, the programming signal current Isig is supplied to the data line X1.

A gate of the selection transistor Trep at the time of emitting light is connected to one second scanning line (scanning line Y11 in FIG. 3A). In addition, the selection transistor Trep at the time of emitting light is turned on in response to the light-emitting period selecting signal Vrep of an H level supplied from the second scanning line Y11, and is turned off in response to the light-emitting period selecting signal Vrep of an L level. In addition, if the selection transistor Trep at the time of emitting light is turned on, the driving transistor supply current Idr is supplied to the organic EL element 221 as the OLED supply current Ioled on the basis of an on state of the driving transistor Tdr.

Next, the operation of each pixel circuit 220 will be briefly described on the basis of FIG. 3B.

Programming Period

If the programming period selecting signal Vprg of an H level is supplied from the first scanning line Y1, the programming transistor Tprg and the selection transistor Tsig at the time of programming are turned on. At this time, the light-emitting period selecting signal Vrep of an L level is supplied from the second scanning line Y11, the selection transistor Trep at the time of emitting light is turned off. In this case, the programming signal current Isig is supplied to the data line X1. In addition, the programming transistor Tprg is turned on, so that the driving transistor Tdr is diode-connected. As a result, the programming signal current Isig flows according to a path formed in the order of the driving transistor Tdr→the selection transistor Tsig at the time of programming→the data line X1. At this time, an electric charge corresponding to a potential of the gate of the driving transistor Tdr is accumulated in the storage capacitor Cstg.

Light-Emitting Period

From this state, if the programming period selecting signal Vprg becomes an L level and the light-emitting period selecting signal Vrep becomes an H level, the programming transistor Tprg and the selection transistor Tsig at the time of programming are turned off, and the selection transistor Trep at the time of emitting light is turned on. At this time, since the accumulated state of the electric charge of the storage capacitor Cstg does not vary, the gate potential of the driving transistor Tdr is held as a voltage when the programming signal current Isig flows. Accordingly, a driving transistor supply current Idr (OLED supply current Ioled) having a current value according to the gate voltage of the driving transistor Tdr flows between the source and drain of the driving transistor Tdr. In detail, the OLED supply current Ioled flows according to a path formed in the order of the driving transistor Tdr→the selection transistor Trep at the time of emitting light→the organic EL element 221. Thereby, the organic EL element 221 emits light with the luminance according to the OLED driving current Ioled (programming signal current Isig).

The above-mentioned operation is sequentially performed in the pixel circuits 220 connected to the first scanning lines Y2 to Yn, so that display corresponding to one frame is performed.

In addition, the panel control circuit 100 of the panel assembly A includes the EEPROM 102 and a reference voltage generating circuit 107. The luminance correction data for adjusting the luminance of each of the organic EL panels 2, 3, and 4 is stored in the EEPROM 102 such that the difference in the luminance of each of the organic EL panels 2, 3, and 4 is corrected, and light emission is performed with the same luminance by the image data having the same gray-scale value. In addition, a parameter for initializing the driver IC 103, for example, data for setting a frame frequency in each of the organic EL panels 2, 3, and 4 is also stored in the EEPROM 102.

In the present embodiment, in order to adjust the luminance of each of the organic EL panels 2, 3, and 4, when a power is supplied, for example, when a power is supplied to the vehicle by key operation, the reference voltage of the D/A converter in the driver IC 103 is corrected by the luminance correction data stored in the EEPROM 102 for each of the R, G, and B. For this reason, the reference voltage generating circuit 107 generates reference voltages VrefR, VrefG, and VrefB for R, G, and B obtained by correcting the reference voltage of the D/A converter when the power is supplied with the luminance correction data, and outputs them to the driver IC 103.

Figure 4:
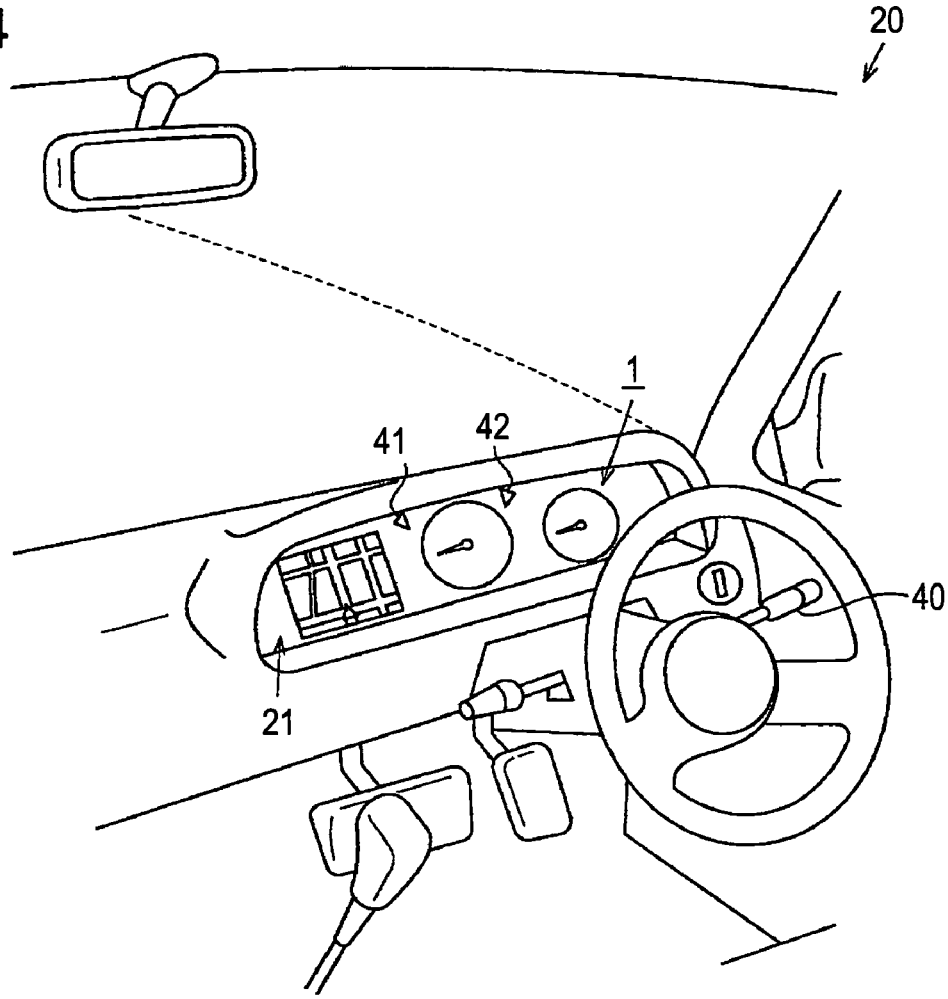
FIG. 4 is a perspective view illustrating an instrument panel of a vehicle on which the display module is mounted.

As shown in FIG. 4, the display module 1 of the movable body is mounted on an instrument panel 21 of a vehicle such as an automobile or the like. Two direction instruction units 41 and 42 in which two light-emitting diodes flicker by the operation of a direction indicator 40 in a vertical direction are provided at left and right sides above a speedometer that performs display on the central organic EL panel. In the two direction instruction units 41 and 42, the two light-emitting diodes simultaneously flicker by the operation of a hazard switch (not shown).

Figure 5:
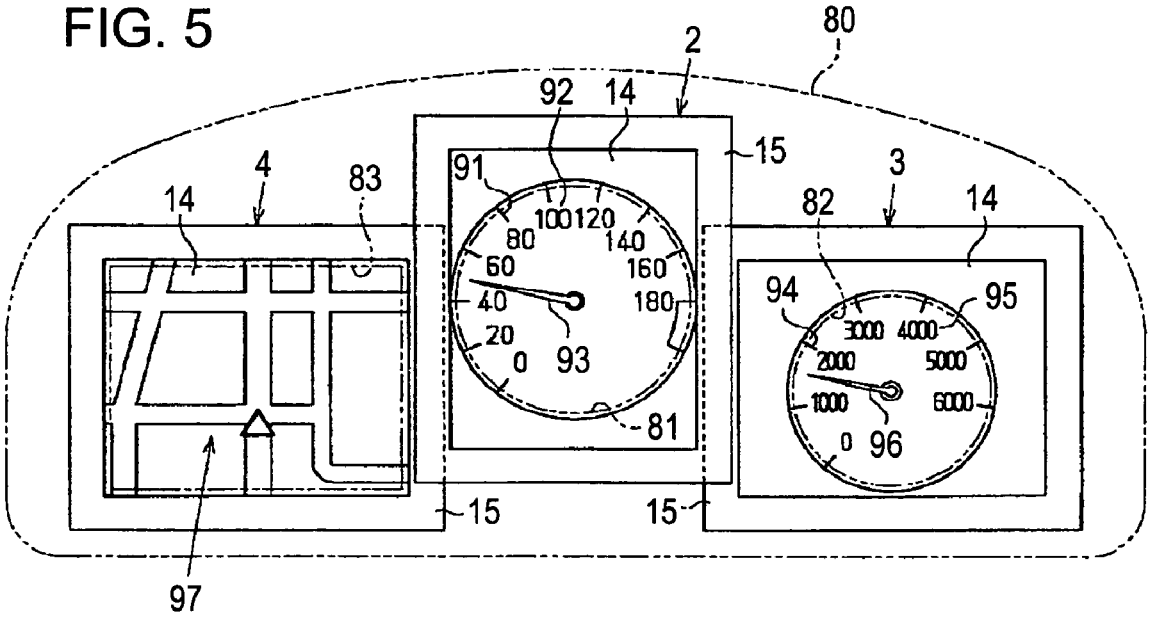
FIG. 5 is a plan view illustrating a display aspect of the display module.

As shown in FIG. 5 as an example, the display module 1 of the movable body makes scales 91, figures 92 and a hand 93 of the speedometer displaying a vehicle speed in an analog form displayed through the central organic EL panel 2. In addition, the display module 1 of the movable body makes scales 94, figures 95 and a hand 96 of a tachometer displaying an engine speed in an analog form displayed through the right organic EL panel 3, and the display module 1 of the movable body makes images 97 such as geographical information of the car navigation device 400 displayed through the left organic EL panel 4. On the organic EL panel 4, an image of a television or an image of a DVD device are also displayed. In FIG. 5, a reference numeral 80 indicates a resin-panel cover that is mounted on a surface of the display module 1 of the movable body mounted on the instrument panel 21. The panel cover 80 is provided with a circular opening 81 for a speedometer performing the display on a display area 14 of the central organic EL panel 2, a circular opening 82 for a tachometer performing the display on the display area 14 of the right organic EL panel 3, and a rectangular opening 83 for an image displayed on the left organic EL panel 4.

Electrical Configuration of Image Controlling Unit

Next, an electrical configuration of the image controlling unit CU will be described in detail with reference to FIG. 1.

In the present embodiment, the display module 1 of the movable body has one image control unit CU with respect to three organic EL panels 2, 3, and 4.

The image control unit CU includes an image control substrate 111 in which an image processing circuit 110 is provided. The image processing circuit 110 creates a plurality of displaying image data on the basis of the input vehicle information data and the image data, and outputs them to the panel controlling circuit 100 of each of the three panel assemblies A, B, and C.

Further, the image controlling unit CU includes a power supply circuit 112 that supplies a power from the plurality of output ports to the organic EL panels 2, 3, and 4, and a plurality of input circuits 113 and 114 (interfaces I/F1 and I/F2) to which the vehicle information data and the image data are respectively input. The image control unit CU further includes a CPU 115 that controls all of the image processing circuit 110, the power supply circuit 112, and the input circuits 113 and 114, a ROM 116 in which various control programs are stored, a ROM 117 in which various image data used for image processing is stored, and a RAM 118 for image processing.

In the ROM 117, background data for displaying scales 91 and figures 92 of the speedometer and background data for displaying scales 94 and figures 95 of the tachometer are stored. In addition, in the ROM 117, image data for creating an image of the hand 93 displayed so as to overlap the scales 91 and the figures 92 of the speedometer and image data for creating an image of the hand 96 displayed so as to overlap the scales 94 and the figures 95 of the tachometer are stored. As a method of displaying the hand 93 or the hand 96 so as to overlap the back images, for example, there are the following two methods. Any one method of the two methods may be used.

According to a first method, a plurality of hand data (two kinds of hand data including hand data for a hand 93 and hand data for a hand 96) each of which position is different at a predetermined angle is stored in the ROM 117, hand data according to the vehicle speed or the engine speed is read out, the read hand data is added to the background data, and displaying image data of each meter is created.

According to a second method, the image data of each of the hand 93 and the hand 96 each having a predetermined angular position according to the vehicle speed or engine speed is created, the created image data of each of the hands is added to the background data, and displaying image data of each meter is created.

Vehicle speed data for making the speedometer perform display through the organic EL panel 2, and engine speed data for making the tachometer perform display through the organic EL panel 3 are input to the input circuit 113. The vehicle speed data detected by the vehicle speed sensor and the engine speed data detected by the engine speed sensor are sequentially transmitted from the ECU (electronic control unit) in the vehicle through a network installed in the vehicle. As a network protocol for the vehicle, for example, CAN (controller area network), Flex Ray or the like are used.

To the input circuit 114, image data such as geographical information or the like (image data for each of the R, G, and B) is input from the car navigation device 400 mounted on the vehicle such as the automobile or the like. In the present embodiment, since a clock signal (synchronization signal) is input to the input circuit 114 together with image data, scanning synchronization is performed in each of the organic EL panels 2, 3, and 4 on the basis of the synchronization signal. In addition, the clock signals (synchronization signals) are received in each of the organic EL panels 2, 3, and 4, the image data is transmitted from the image control unit CU to each of the panel assemblies A, B, and C, and the scanning may be performed in each of the organic EL panels 2, 3, and 4. In addition, image data, which is transmitted from another system such as a television, a video device or the like, and image data, which is transmitted from a storage device such as an HDD, a DVD or the like, can be input to the input circuit 114.

In the image control unit CU shown in FIG. 1, a reference character a indicates a vehicle information data controlling signal, a reference character b indicates an image data controlling signal, a reference character c indicates an image processing circuit controlling signal, a reference character d indicates a power supply circuit controlling signal, a reference character e indicates a panel assembly controlling signal, a reference character f indicates vehicle information data, and a reference character g indicates image data. Further, a reference character h indicates a power supply signal supplied to the panel assembly A, a reference character i indicates a power supply signal supplied to the panel assembly B, a reference character j indicates a power supply signal supplied to the panel assembly C, a reference character k indicates image data supplied to the panel assembly A, a reference character l indicates image data supplied to the panel assembly B, a reference character m indicates image data supplied to the panel assembly C. In addition, a reference character n indicates a control signal of the RAM 118.

The CPU 115 performs control so as to transmit the vehicle information data f (vehicle speed data and engine speed data) sequentially input to the input circuit 113 through the vehicle information data controlling signal a to the image processing circuit 110. Further, the CPU 115 performs control so as to transmit the image data input to the input circuit 114 through the image data controlling signal g to the image processing circuit 110. Furthermore, the CPU 115 performs control so as to output the power supply signals h, i, and j to the respective panel assemblies A, B, and C from the respective output ports of the power supply circuit 112 through the power supply circuit controlling signal d. Furthermore, the CPU 115 performs control so as to output the image data k, l, and m to the respective panel assemblies A, B, and C from the image processing circuit 110 through the luminance adjusting circuit 330 serving as the luminance adjusting unit by means of the image processing circuit controlling signal c. Furthermore, the CPU 115 performs control so as to output the panel assembly control signal e to the respective panel assemblies A, B, and C.

The display module 1 of the movable body having the above-mentioned structure displays a speedometer indicating a speed according to the vehicle speed data input to the input circuit 113 on the organic EL panel 2 and displays a tachometer indicating the engine speed according to the engine speed data input to the input circuit 113 on the organic EL panel 3 (see FIG. 5). Further, when the image data of the geographical information or the like is input to the input circuit 114 from the car navigation device 400, the display module 1 of the movable body makes the image data displayed on the organic EL panel 4 (see FIG. 5).

In addition, as shown in FIG. 1, the image control unit CU of the display module 1 of the movable body includes a temperature detecting circuit 300 serving as a temperature detecting unit, an A/D converter 310, a controller 320, and a luminance adjusting circuit 330.

The temperature detecting circuit 300 detects the temperature of any one of three organic EL panels 2 to 4 by using a temperature sensor (not shown), and outputs a temperature signal r of an analog signal indicating the detected temperature of the corresponding organic EL panel (temperature of the display panel) to the A/D converter 310. For example, a thermocouple, a temperature sensor of a semiconductor or the like are used as the temperature sensor.

The A/D converter 310 converts the temperature signal r of the organic EL panel into the digital signal, and outputs the temperature signal s of the organic EL panel to be the digital signal to the controller 320.

The controller 320 compares a value of the temperature signal s of the organic EL panel (temperature of the organic EL panel) with a predetermined threshold value, and outputs a display aspect changing signal u for changing a display aspect of each of the organic EL panels 2 to 4 on the basis of the comparison result to the luminance adjusting circuit 330. If the value of the temperature signal s of the organic EL panel becomes larger than the predetermined threshold value, the display aspect changing signal u is a signal that changes the display aspect of each of the organic EL panels 2 to 4 so as to decrease the luminance of an organic EL element 221, among the organic EL elements 221 of each of the pixels 210A in the respective organic EL panels 2 to 4, having high temperature dependency of characteristic deterioration.

In the present embodiment, if the temperature of the organic EL panel becomes larger than the threshold value, the display aspect of each of the organic EL panels 2 and 3 is changed so as to decrease the luminance of an organic EL element 221, among three kinds of organic EL elements 221 for R (red), G (green), and B (blue), having a color with high temperature dependency of characteristic deterioration.

In the present embodiment, as a specific aspect, if the temperature of the organic EL panel is larger than the predetermined threshold value, the luminance of all the three kinds of organic EL elements 221 for R, G, and B is maintained to be constant. In this state, control for changing a luminance ratio of each of the three kinds of organic EL elements 221 for R, G, and B (hereinafter, referred to as luminance ratio changing control) is performed so as to decrease the luminance of an organic EL element 221, among the three kinds of organic EL elements 221 for R, G, and B, having a color with high temperature dependency of characteristic deterioration. In the present embodiment, as an example, 'the organic EL elements 221 each having a color with high temperature dependency of characteristic deterioration' are set as the red organic EL element and the green organic EL element, and 'the organic EL element 221 having a color with low temperature dependency of characteristic deterioration' is set as the blue organic EL element. In the present embodiment, as an example, changed is the display aspect of each of the organic EL panels 2 and 3 among the three organic EL panels 2 to 4.

In order to perform the luminance ratio changing control, if the temperature of the organic EL panel is larger than the predetermined threshold value, the controller 320 outputs the display aspect changing signal u serving as the luminance adjusting signal to the luminance adjusting circuit 330. If the display aspect changing signal u is input, the luminance adjusting circuit 330 changes a luminance ratio of each of the three kinds of organic EL elements 221 for R, G, and B (distribution of the luminance) from a luminance ratio of white shown by a dot W of FIG. 7 to a luminance ratio shown by a dot 400, and changes the display of each of the organic EL panels 2 and 4 from the display on the basis of white to the display on the basis of a color with low temperature dependency of characteristic deterioration (in the present example, blue). The reason why the display in the organic EL panel 2 is changed from the display on the basis of white to the display on the basis of blue is to display the background including the scales 91 and the figures 92 of the speedometer shown in FIG. 5. In addition, the reason why the display in the organic EL panel 3 is changed from the display on the basis of white to the display on the basis of blue is to display the background including the scales 94 and the figures 95 of the tachometer shown in FIG. 5.

Figure 6:
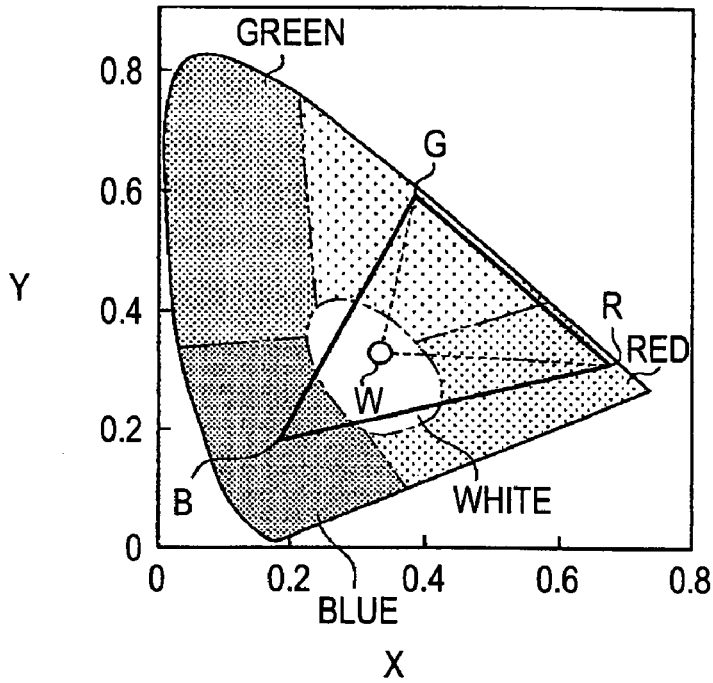
FIG. 6 is a chromaticity diagram used for illustrating the first embodiment.
Figure 7:
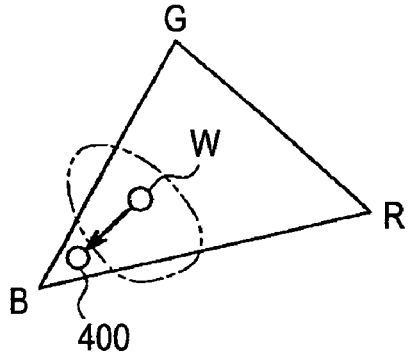
FIG. 7 is a diagram illustrating a modification of a display aspect according to the first embodiment.

The dot W of FIG. 7 corresponds to the dot W of FIG. 6. The chromaticity diagram of FIG. 6 illustrates a case in which the color can be reproduced within a range of a color triangle obtained by coupling the chromatic coordinates of three points of R, G, and B with each other. The white shown by the dot W in FIG. 6 is determined by the luminance ratio of each of the R, G, and B (distribution of the luminance) specified by the chromatic coordinates of x=0.33 and y=0.33. The luminance ratio of each of the R, G, and B is changed within a range of a color triangle, so that a color balance of the display of each of the organic EL panels 2 and 3 is changed.

Figure 8A:
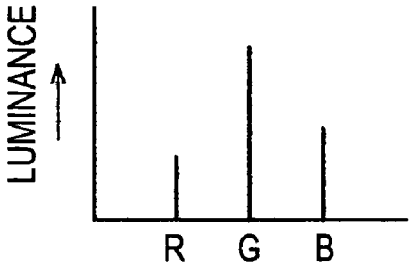
FIG. 8A is a graph illustrating a luminance ratio of white display.
Figure 8B:
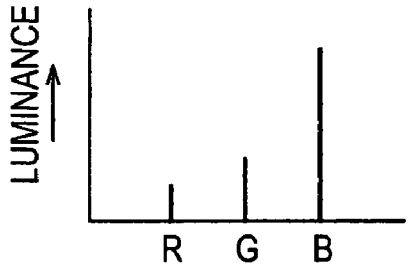
FIG. 8B is a graph illustrating a luminance ratio of blue display.

FIG. 8A illustrates a luminance ratio of each of the R, G, and B in white shown by a dot W in FIG. 7, and FIG. 8B illustrates a luminance ratio of each of the R, G, and B shown by a dot 400 in FIG. 7. In the present example, the luminance ratio of each of the R, G, and B is changed from the luminance ratio of white shown in FIG. 8A to the luminance ratio shown in FIG. 8B through the luminance ratio changing control, so that the display is changed from the display on the basis of white to the display on the basis of blue shown by a dot 400 of FIG. 7. In addition, when the luminance ratio of each of the R, G, and B is changed through the luminance ratio changing control, the luminance in all of the three kinds of organic EL elements 221 for the R, G, and B shown in FIG. 8A and the luminance in all of the three kinds of organic EL elements 221 for R, G, and B shown in FIG. 8B are maintained to be constant.

As such, if the temperature of the organic EL panel exceeds the predetermined threshold value and the display aspect changing signal u is input, the luminance adjusting circuit 330 increases the luminance ratio of blue (B) from the luminance ratio shown in FIG. 8A and decreases the luminance ratio of each of R (red) and G (green). For this reason, the luminance adjusting circuit 330 reduces a value of a current flowing through organic EL elements (red organic EL element and green organic EL element), among the three kinds of organic EL elements 221 for R, G, and B of one pixel 210A of each of the organic EL panels 2 and 3, having a color with high temperature dependency of characteristic deterioration. In addition, the luminance adjusting circuit 330 increases a value of a current flowing through an organic EL element of a color with low temperature dependency of characteristic deterioration (blue organic EL element).

As such, as a method of, by means of the luminance adjusting circuit 330, decreasing the value of the current flowing through the red organic EL element and the green organic EL element, increasing the value of the current flowing through the blue organic EL element, and changing the luminance ratio of each of the R, G, and B, any one of the following three methods may be used.

(1) According to a first method, decreased is a reference voltage supplied to a power line 340 (see FIG. 3A) of each of the pixel circuits for red (R) and green (G) among three kinds of pixel circuits for R, G, and B constituting one pixel circuit 220, and increased is a reference voltage supplied to the power line 340 of the pixel circuit for blue (B).

(2) According to a second method, a reference voltage of the DAC (D/A converter) in the driver IC 103 serving as the data line driving circuit is changed for each of the three kinds of pixel circuits for R, G, and B. For example, the signal for changing the reference voltage is output to the reference voltage generating circuit 107 shown in FIG. 2.

(3) According to a third method, a gray-scale value of the image data for each pixel output from the image processing circuit 110, for example, a gray-scale value of the 8-bit image data is changed with reference to a map stored in advance in the ROM 117, and the image data k, l, and m of changed pixels are output to the organic EL panels 2 and 3.

In the present embodiment, the method (3) is illustrated in FIG. 1, but when the method (1) is used, the temperature signal s output from the A/D converter of FIG. 1 is input to the CPU 115, and the reference voltage supplied to the power line 340 is changed by means of the power supply circuit controlling signal d. In addition, when the method (2) is used, the temperature signal s output from the A/D converter of FIG. 1 is input to the CPU 115, and the reference voltage is changed by means of the panel assembly controlling signal e.

If the temperature of the organic EL panel becomes larger than the threshold value, the controller 320 and the luminance adjusting circuit 330 maintain the luminance in all of the three kinds of light-emitting elements for R, G, and B as a predetermined value. They correspond to the display aspect changing unit that changes the luminance ratio of each of the three kinds of light-emitting elements so as to decrease the luminance of the light-emitting element, among the three kinds of light-emitting elements for R, G, and B, having a color with high temperature dependency of characteristic deterioration.

According to the first embodiment having the above-mentioned structure, the following effect can be achieved.

If the temperature of the organic EL panel detected by the temperature detecting circuit 300 becomes larger than the predetermined threshold value, the display of the background of each of the organic EL panels 2 and 3 is changed from the display on the basis of white to the display on the basis of blue having strong resistance against the high temperature while maintaining the luminance in all of the three kinds of organic EL elements 221 for R, G, and B at a predetermined value. Thereby, the organic EL element 221 having high temperature dependency of characteristic deterioration can be prevented from being deteriorated without changing the luminance of the entire screen, and the life span of each of the organic EL panels 2 and 3 can be lengthened.

In addition, when the temperature of each of the organic EL panels 2 and 3 is larger than the threshold value or when the temperature of each of the organic EL panels 2 and 3 is not more than the threshold value, the luminance ratio of each of the three kinds of organic EL elements 221 for R, G, and B is changed, that is, the color balance is changed in the display by changing the display from the display on the basis of white to the display on the basis of blue. Accordingly, in the case in which the display module 1 of the movable body according to the present embodiment is mounted on the instrument panel 21 of the vehicle such as the automobile serving as the movable body (see FIG. 4), even when the temperature of the organic EL panel becomes a high temperature, the display aspect of all the instrument panel 21 can be changed while increasing the life span of the organic EL panel. Accordingly, even when the temperature of the organic EL panel becomes a high temperature, various information display or image display can be performed while preventing the organic EL element from being deteriorating.

Second Embodiment

Next, a display module 1 of a movable body according to a second embodiment of the invention will be described with reference to FIG. 9. Also in the present embodiment, if the temperature of the organic EL panel becomes larger than the threshold value, the display aspect of each of the organic EL panels 2 and 3 is changed so as to decrease the luminance of an organic EL element 221, among three kinds of organic EL elements 221 for R, G, and B of each pixel 210A, having a color with high temperature dependency of characteristic deterioration. In the present embodiment, as a specific aspect, if the temperature of the organic EL panel becomes larger than the predetermined threshold value, control is performed such that the display of the background color of the image displayed in each of the organic EL panels 2 and 3 is changed from the display on the basis of a color of the organic EL element 221, among the three kinds of organic EL elements 221 for R, G, and B, having high temperature dependency of characteristic deterioration, to the display on the basis of a color of the organic EL element 221, among the three kinds of organic EL elements 221, having low temperature dependency of characteristic deterioration.

Figure 9:
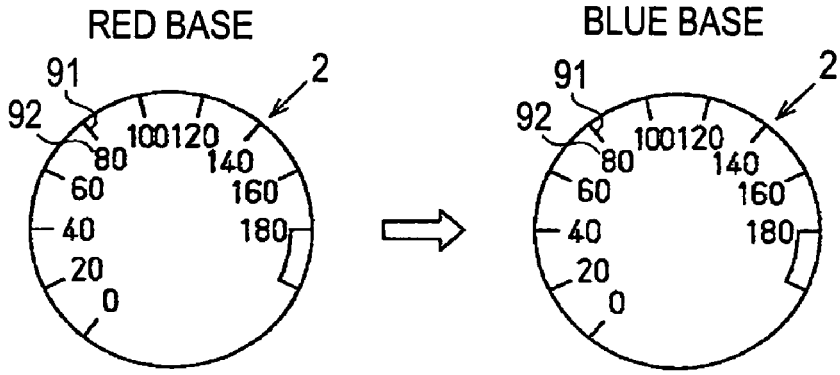
FIG. 9 is a diagram illustrating a modification of a display aspect according to a second embodiment.

In the present embodiment, as an example, if the temperature of the organic EL panel becomes larger than the predetermined threshold value, the display of the background color of the image displayed in each of the organic EL panels 2 and 3 is changed from the display on the basis of a color having high temperature dependency of characteristic deterioration (for example, red) to the display on the basis of a color having low temperature dependency of characteristic deterioration (for example, blue), as shown in FIG. 9. Here, 'the background color of the image' means a display color of the background that includes scales 91 and figures 92 of the speedometer (shown in FIG. 5) performing the display in the organic EL panel 2, and means a display color of the background that includes scales 94 and figures 95 of the tachometer (shown in FIG. 5) performing the display in the organic EL panel 3. In addition, in FIG. 9, the display through the organic EL panel 2 is shown. However, also in the display through the organic EL panel 3, in the same manner as the organic EL panel 2, if the temperature of the organic EL panel becomes larger than the threshold value, the display of the background color is changed from the display on the basis of red to the display on the basis of blue.

In order to perform the background color changing control, if the temperature of the organic EL panel becomes larger than the threshold value, the controller 320 outputs the display aspect changing signal u serving as the luminance adjusting signal to the luminance adjusting circuit 330. If the display aspect changing signal u is input, the luminance adjusting circuit 330 changes the distribution of the luminance of each of the three kinds of organic EL elements 221 for the R, G, and B, and changes the display of each of the organic EL panels 2 and 4 from the display on the basis of red to the display on the basis of a color with low temperature dependency of characteristic deterioration (that is, blue). As a method of changing the distribution of the luminance through the luminance adjusting circuit 330, any one method of the above-mentioned three methods may be used in the same manner as the case of changing the luminance ratio of each of the R, G, and B.

According to the second embodiment having the above-mentioned structure, the following effects can be achieved.

If the temperature of the organic EL panel becomes larger than the threshold value, the display of the background color of the image displayed on each of the organic EL panels 2 and 4 is changed from the display on the basis of the color (red) of an organic EL element 221 having high temperature dependency of characteristic deterioration to the display on the basis of the color (blue) of an organic EL element 221 having low temperature dependency of characteristic deterioration. Thereby, the display aspect can be changed while increasing the life span of the organic EL panel.

When the temperature of the organic EL panel is low or when the temperature of the organic EL panel is high, since the background color of the image displayed in each of the organic EL panels 2 and 3 is changed, a user is under the impression that the display aspect of the instrument panel 21 (see FIG. 4) is changed.

Third Embodiment

Next, a display module 1 of a movable body according to a third embodiment of the invention will be described with reference to FIG. 10.

In the above-mentioned second embodiment, the temperature of each of the organic EL panels detected by the temperature detecting circuit 300 is compared with one threshold value. In the meantime, in the third embodiment, two threshold values including a first threshold value having a small value and a second threshold value having a large value are set as threshold values that are to be compared with the temperature of each of the organic EL panels, and the background color of the image displayed in each of the organic EL panels 2 and 4 can be changed in three stages.

Figure 10:
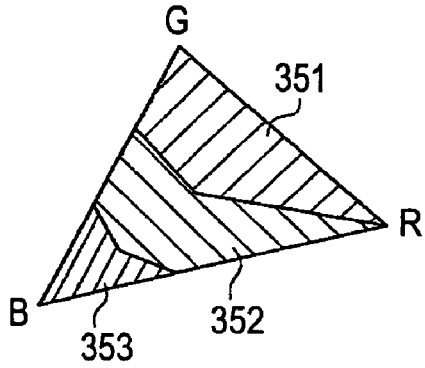
FIG. 10 is a diagram illustrating a modification of a display aspect according to a third embodiment.

That is, when the temperature of the organic EL panel is lower than the first threshold value, the display of the background color is change to the display on the basis of red in which the distribution of the luminance of each of the three kinds of organic EL elements 221 for R, G, and B is determined by the predetermined color coordinates within a region 351 in FIG. 10. When the temperature of the organic EL panel is not less than the first threshold value and is not more than the second threshold value, the display of the background color is changed from the display on the basis of red to the display on the basis of white determined by the predetermined color coordinates within the region 352 of FIG. 10. In addition, if the temperature of the organic EL panel becomes larger than the second threshold value, the display of the background color is changed from the display on the basis of white to the display on the basis of blue determined by the predetermined color coordinates within the region 353 in FIG. 10.

According to the third embodiment having the above-mentioned structure, the following effects can be achieved.

In the third embodiment, the two threshold values are set as the threshold values that are to be compared with the temperature of the organic EL panel, and the background color of the image displayed in each of the organic EL panels 2 and 4 is changed in three stages. Accordingly, the life span of the organic EL panel can be increased, and the display aspect can be further changed.

Fourth Embodiment

Next, a display module 1 of a movable body according to a fourth embodiment will be described with reference to FIGS. 11A and 11B. In the present embodiment, if the temperature of the organic EL panel becomes larger than the threshold value, the display aspect of each of the organic EL panels 2 and 3 is changed so as to decrease the luminance of an organic EL element 221, among three kinds of organic EL elements 221 for R, G, and B, having a color with high temperature dependency of characteristic deterioration. As a specific aspect, in the present embodiment, if the temperature of the organic EL panel becomes larger than the threshold value, control (luminance changing control) is performed so as to decrease the luminance of each of the three kinds of organic EL elements 221 for R, G, and B without changing the luminance ratio of each of the three kinds of organic EL elements 221 for R, G, and B.

Figure 11A:
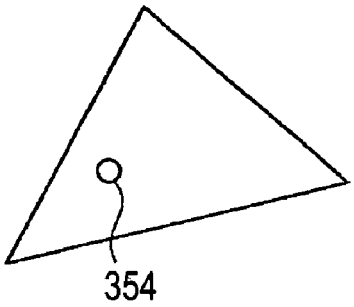
FIG. 11A is a diagram illustrating a modification of a display aspect according to a fourth embodiment.
Figure 11B:
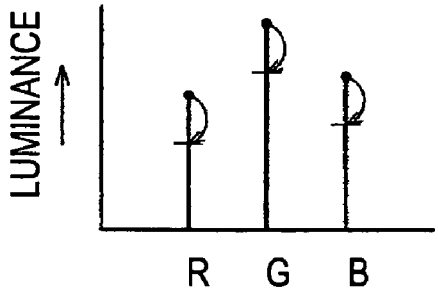
FIG. 11B is a diagram illustrating a modification of the display aspect according to the fourth embodiment.

That is, in the present embodiment, if the temperature of the organic EL panel becomes larger than the threshold value, the luminance ratio of the color shown by a dot 354 in FIG. 11A (luminance ratio of each of the three kinds of organic EL elements 221 for R, G, and B) is not changed, and the luminance of each of the three kinds of organic EL elements 221 is decreased by the same amount, as shown in FIG. 11B. If considering the visibility of the speedometer or tachometer performing the display as shown in FIG. 5, it is preferable that the luminance of each of the three kinds of organic EL elements 221 for R, G, and B be decreased within a range of 10%.

In order to perform the luminance changing control, if the temperature of the organic EL panel becomes larger than the threshold value, the controller 320 shown in FIG. 1 outputs the display aspect changing signal u serving as the luminance adjusting signal to the luminance adjusting circuit 330. If the display aspect changing signal u is input, the luminance adjusting circuit 330 decreases the luminance of each of the three kinds of organic EL elements 221 for R, G, and B within a range of 10% by the same amount. As a method of decreasing the luminance of each of the three kinds of organic EL elements 221 for R, G, and B, any one method of the above-mentioned three methods may be used in the same manner as the case of changing the luminance ratio of each of the R, G, and B.

According to the fourth embodiment having the above-mentioned structure, the following effects can be achieved.

If the temperature of the organic EL panel becomes larger than the threshold value, the luminance ratio of each of the three kinds of organic EL elements 221 for R, G, and B is not changed, and the luminance of each of the three kinds of organic EL elements 221 is decreased by the same amount. As a result, an organic EL element having high temperature dependency of characteristic deterioration can be prevented from being deteriorated, and the life span of the organic EL panel can be lengthened.

Fifth Embodiment

Next, a display module 1 of a movable body according to a fifth embodiment of the invention will be described with reference to FIGS. 12A and 12B. In the present embodiment, if the temperature of the organic EL panel becomes larger than the threshold value, the display aspect of each of the organic EL panels 2 and 3 is changed so as to decrease the luminance of an organic EL element, among the three kinds of organic EL elements 221 for R, G, and B, having the color with high temperature dependency of characteristic deterioration.

Figure 12A:
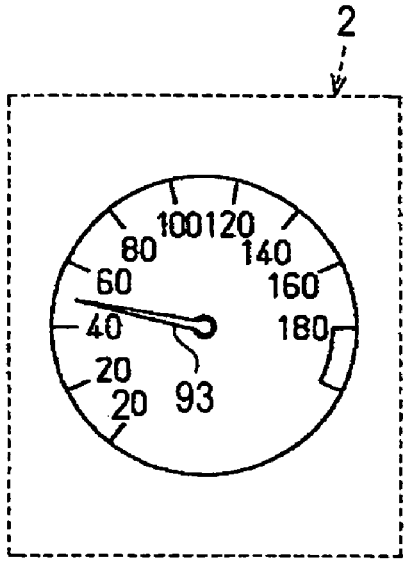
FIG. 12A is a diagram illustrating a modification of a display aspect according to a fifth embodiment.
Figure 12B:
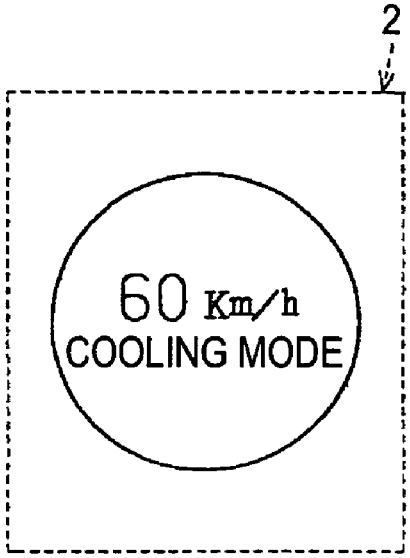
FIG. 12B is a diagram illustrating a modification of the display aspect according to the fifth embodiment.

As a specific aspect, in the present embodiment, if the temperature of the organic EL panel becomes larger than the threshold value, the display of each of the organic EL panels 2 and 3 is changed from analog display (see FIG. 12A) to digital display (see FIG. 12B). In addition, control (display region changing control) is performed so as to change the display from display on the basis of color (red) of an organic EL element, among the three kinds of organic EL elements 221 for R, G, and B, having high temperature dependency of characteristic deterioration, to the display on the basis of the color (blue) having low temperature dependency of characteristic deterioration. The image processing unit for performing the display region changing control is composed of the image processing circuit 110 and the luminance adjusting circuit 330 shown in FIG. 1.

In order to perform the display region changing control, if the temperature of the organic EL panel becomes larger than the threshold value, the controller 320 shown in FIG. 1 outputs the display aspect changing signal t (see FIG. 1) for changing the display from the analog display to the digital display to the image processing circuit 110, and outputs the display aspect changing signal u to the luminance adjusting circuit 330.

In addition, if the display aspect changing signal t is input, the image processing circuit 110 outputs to the luminance adjusting circuit 330 the image data for changing the display of each of the organic EL panels 2 and 3 from the analog display shown in FIG. 12A to the digital display shown in FIG. 12B. At this time, the image processing circuit 110 also outputs to the luminance adjusting circuit 330 the display data of a message 'a cooling mode' notifying that the digital display is temporary display until the temperature of the organic EL panel decreases to be a value not more than the threshold value, in addition to the image data for changing the analog display into the digital display. In addition, as an example, the analog display is display on the basis of red (see FIG. 12A).

In addition, if the display aspect changing signal u is input, the luminance adjusting circuit 330 changes the luminance ratio of the image data output from the image processing circuit 110 into the luminance ratio for changing the display from the display on the basis of red to the display on the basis of blue, and outputs the corresponding image data to each of the organic EL panels 2 and 3. Thereby, if the temperature of the organic EL panel becomes larger than the threshold value, the display is changed from the analog display on the basis of red shown in FIG. 12A to the digital display on the basis of blue shown in FIG. 12B.

In addition, in the vehicle such as the automobile or the like, if the engine starts in the middle of summer, since the temperature of the vehicle interior or the temperature of the organic EL panel much increases, the digital display is performed using the color (blue) with low temperature dependency of characteristic deterioration, and the message of 'the cooling mode' is displayed. During the time the temperature of the vehicle interior and the temperature of the organic EL panel are decreased by the air conditioner while the vehicle travels, the message is deleted, so that the display state returns to an analog display in which the organic EL element displays the meter using with the color (for example, red) with high temperature dependency of characteristic deterioration.

According to the fifth embodiment having the above-mentioned structure, the following effect can be achieved.

If the temperature of the organic EL panel is low, the display in each of the organic EL panels 2 and 3, for example, the display of various movable body information such as the vehicle speed or the engine speed is displayed in an analog form by the meter, and if the temperature of the organic EL panel becomes larger than the threshold value, the display of various movable body information is displayed in a digital form using the color (blue) having low temperature dependency of characteristic deterioration. For this reason, even in the severe environment in which the temperature of the organic EL panel becomes a high temperature, the organic EL element having high temperature dependency of characteristic deterioration is prevented from being deteriorated, so that the display aspect can be changed while increasing the life span of the organic EL panel.

By means of the message 'cooling mode' displayed together with the digital display shown in FIG. 12B, it is possible to notify a driver that the digital display is only temporary display until the temperature of the organic EL panel decreases.

In addition, modifications of the invention can be specified.

In the above-mentioned embodiments, the display module of the movable body where the invention is specified has been described. However, the invention is not limited to the display module of the movable body. The invention can be applied to the following display device. This display device includes one display panel that has a plurality of pixels that are arranged in a matrix so as to correspond to intersections of a plurality of scanning lines and a plurality of data lines, each of the plurality of pixels having a plurality of light-emitting elements (for example, three kinds of organic EL elements for R, G, and B). In this case, the display device drives the display panel on the basis of the image data. Also in this display device, the invention is applied. That is, if the temperature of the light-emitting element of the organic EL panel or the like becomes larger than the threshold value, the display aspect of the organic panel (for example, organic EL panel) is changed so as to decrease the luminance of a light-emitting element, among the three kinds of light-emitting elements for R, G, and B, having the color with high temperature dependency of characteristic deterioration. Specifically, the specific aspect, which has already been described with respect to the change of the display aspect, is applied to this display device.

In the above-mentioned embodiments, the display module 1 of the movable body has a structure in which one image control unit CU is provided with respect to three organic EL panels 2, 3, and 4, as shown in FIG. 1. However, a structure in which an image control unit is individually provided in each of the three organic EL panels 2, 3, and 4 can be applied to the invention.

In the first embodiment, if the temperature of the organic EL panel becomes larger than the threshold value, the luminance in all of the three kinds of organic EL elements 221 for R, G, and B is maintained to be a predetermined value, and the display of the background color in each of the organic EL panels 2 and 3 is changed from the display on the basis of white to the display on the basis of blue having low temperature dependency of characteristic deterioration. However, the invention is not limited thereto. That is, the invention can be applied to the structure in which the display on the basis of red or green with high temperature dependency of characteristic deterioration is changed into the display on the basis of blue with low temperature dependency of characteristic deterioration.

In the second embodiment, as an example, if the temperature of the organic EL panel becomes larger than the threshold value, the display of the background color of the image displayed in each of the organic EL panels 2 and 3 is changed from the display on the basis of red to the display on the basis of blue, but may be changed from the display on the basis of green to the display on the basis of blue.

In the third embodiment, the two threshold values are set as the threshold values compared with the temperature of the organic EL panel, and the display of the background color of the image displayed in each of the organic EL panels 2 and 4 is changed in three stages. However, the number of the threshold values may be '3' or more. The number of threshold values is increased, so that the display of the background color of the image displayed in each of the organic EL panels 2 and 3 can be changed with the multiple stages.

In the fifth embodiment, if the temperature of the organic EL panel becomes larger than the threshold value, various movable body information is displayed in a digital form on the basis of blue, but the invention is not limited thereto. In short, when the digital display is performed on the basis of the color with low temperature dependency of characteristic deterioration, the color is not limited to the blue.

In the first embodiment, in order to adjust the luminance of each of the organic EL panels 2, 3, and 4, when the power is supplied, the reference voltage of the D/A converter in the driver IC 103 is corrected for each of the R, G, and B by means of the luminance correction data stored in the EEPROM 102. The invention is not limited thereto. For example, the invention can be applied to a method in which the reference voltage of each pixel 210A (high-potential power supply Vdd connected to the source of the driving transistor Tdr in the pixel circuit shown in FIG. 3A) is corrected by the luminance correction data for each of three kinds of organic EL elements 221 for R, G, and B. Alternatively, the invention can be applied to a method in which the luminance of each of three kinds of organic EL elements 221 for R, G, and B of each pixel is corrected by the luminance correction data, and each of the organic EL panels 2, 3, and 4 is driven using the corrected image data.

In the first embodiment, the driver IC 103 constructed as the data line driving circuit is mounted on the flexible wiring substrate 104, but the invention can be applied to a structure in which the data line driving circuit is formed on a light-emitting element substrate 11 of each of the organic EL panels 2 to 4.

In the first embodiment, the number of the organic EL panels is '3', but the number of organic EL panels is only an example. That is, the invention can be applied to a display module of a movable body using a plurality of organic EL panels having the number of organic EL panels other than '3'.

In the first embodiment, an organic EL panel using organic EL elements has been used as a display panel, but the invention can be also applied to a structure in which an inorganic EL panel using inorganic EL elements is used as a display panel.

In the first embodiment, an image of geographical information of the car navigation device 400 is displayed using one of the three organic EL panels, but a back monitoring video of a vehicle may be displayed using the organic EL panel. In short, the display aspects displayed in the plurality of organic EL panels may be arbitrarily selected.

In the first embodiment, even when some of the plurality of organic EL panels are disposed at locations other than an instrument panel of a vehicle such as an automobile or the like, the invention can be applied. For example, the invention can be applied to a structure in which some of a plurality of organic EL panels are disposed at locations where images displayed on the organic EL panel is viewed by a passenger sitting in the back of the vehicle.

What is claimed is:

1. A display device comprising:

a display panel including:

a plurality of scan lines;

a plurality of data lines;

a plurality of pixels disposed in a matrix so as to correspond to intersections of the plurality of scanning lines and the plurality of data lines; and a plurality of light-emitting elements provided in each of the plurality of pixels, the light-emitting elements including first light-emitting elements that have a deterioration characteristic that depends greatly on temperature and second light-emitting elements that have a deterioration characteristic that depends relatively little on temperature;

a temperature detecting unit that detects the temperature of the display panel; and a display aspect changing unit that changes a display aspect of the display panel so as to decrease the luminance of the first light-emitting elements when the temperature of the display panel detected by the temperature detecting unit becomes larger than a predetermined threshold value, the display aspect changing unit having a luminance adjusting unit that, when the temperature of the display panel becomes larger than the predetermined threshold value, changes a luminance ratio of the first and second light-emitting elements so as to decrease the luminance of the first light-emitting elements while collectively maintaining overall luminance of the first and second light-emitting elements.

2. The display device according to claim 1, wherein each of the plurality of pixels has three kinds of light-emitting elements that includes a red light-emitting element to irradiate a red light component, a green light-emitting element to irradiate a green light component, and a blue light-emitting element to irradiate a blue light component.

3. The display device according to claim 2, wherein the display aspect changing unit has a luminance adjusting unit that changes display of a background color of an image displayed on the display panel into display on the basis of a color of the second light-emitting elements when the temperature of the display panel becomes larger than the predetermined threshold value.

4. The display device according to claim 2, wherein the display aspect changing unit has an image processing unit that changes the display in the display panel from analog display to digital display and changes the digital display into display on the basis of a color of the second light-emitting elements when the temperature of the display panel becomes larger than the predetermined threshold value.

5. The display device according to claim 4, wherein the display aspect changing unit displays on the display panel a message indicating that the digital display is a temporary display until the temperature of the display panel decreases, when the digital display is performed on the display panel.

* * * * *